US008603261B2

(12) United States Patent
Rosenbauer et al.

(10) Patent No.: US 8,603,261 B2
(45) Date of Patent: Dec. 10, 2013

(54) DISHWASHING MACHINE WITH A PUMP WITH A BRUSHLESS PERMANENT MAGNET MOTOR

(75) Inventors: Michael Rosenbauer, Reimlingen (DE); Hans-Dieter Rossteuscher, Giengen (DE); Martin Stickel, Giengen/Brenz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 888 days.

(21) Appl. No.: 12/664,898

(22) PCT Filed: Jun. 10, 2008

(86) PCT No.: PCT/EP2008/057241

§ 371 (c)(1),
(2), (4) Date: Dec. 16, 2009

(87) PCT Pub. No.: WO2009/003801

PCT Pub. Date: Jan. 8, 2009

(65) Prior Publication Data

US 2010/0186787 A1 Jul. 29, 2010

(30) Foreign Application Priority Data

Jun. 29, 2007 (DE) ..... 10 2007 030 065

(51) Int. Cl.
*B08B 3/02* (2006.01)

(52) U.S. Cl.
USPC ..... 134/57 D; 134/56 D; 134/58 D

(58) Field of Classification Search
USPC ..... 134/56 D, 57 D, 58 D
See application file for complete search history.

(56) References Cited

U.S. PATENT DOCUMENTS

| | | | | |
|---|---|---|---|---|
| 4,799,855 | A | 1/1989 | Milocco et al. | |
| 5,241,975 | A * | 9/1993 | Yanagihara | 134/56 D |
| 5,675,226 | A | 10/1997 | Riola' | |
| 6,249,094 | B1 | 6/2001 | Zeh et al. | |
| 6,775,468 | B2 | 8/2004 | Zinke et al. | |
| 7,216,514 | B2 * | 5/2007 | Sakita et al. | 68/12.12 |
| 7,614,408 | B2 | 11/2009 | Park et al. | |
| 2005/0022849 | A1 | 2/2005 | Park et al. | |
| 2006/0086380 | A1 * | 4/2006 | Choi et al. | 134/56 D |
| 2006/0175917 | A1 * | 8/2006 | Nanbu et al. | 310/71 |
| 2007/0163626 | A1 | 7/2007 | Klein | |
| 2007/0181156 | A1 | 8/2007 | Uz et al. | |

FOREIGN PATENT DOCUMENTS

| | | | |
|---|---|---|---|
| DE | 3802890 | A1 | 8/1989 |
| DE | 3911305 | A1 | 10/1989 |
| DE | 19840291 | A1 | 3/2000 |

(Continued)

OTHER PUBLICATIONS

Machine translation of DE 10339130 to Schrott, Mar. 2004.*

(Continued)

*Primary Examiner* — Michael Barr
*Assistant Examiner* — Benjamin L Osterhout
(74) *Attorney, Agent, or Firm* — James E. Howard; Andre Pallapies

(57) ABSTRACT

A dishwashing machine having a pumping device to pump a dishwashing solution. The pumping device has a first pump and a second pump, wherein each of the first pump and the second pump has a brushless permanent magnet motor. A shared electronic controller is shared by the first pump and the second pump.

12 Claims, 2 Drawing Sheets

(56) References Cited

FOREIGN PATENT DOCUMENTS

| | | | |
|---|---|---|---|
| DE | 10225258 | A1 | 12/2003 |
| DE | 10339130 | A1 | 3/2004 |
| DE | 10154630 | B4 | 7/2006 |
| EP | 1586265 | A1 | 10/2005 |
| JP | 2001-276479 | A | 10/2001 |
| JP | 2004-278539 | A | 10/2004 |
| JP | 2005177148 | A * | 7/2005 |
| WO | WO 2005070275 | A1 * | 8/2005 |

OTHER PUBLICATIONS

Machine translation of WO 2005070275 to Klein, Aug. 2005.*
Machine translation of Abstract of JP 2005177148 to Miyataka et al., Jul. 2007.*
Report of Examination CN 200880022728.7.

* cited by examiner

DISHWASHING MACHINE WITH A PUMP WITH A BRUSHLESS PERMANENT MAGNET MOTOR

BACKGROUND OF THE INVENTION

The invention relates to a dishwashing machine having at least one pumping device for pumping dishwashing solution, the pumping device having at least one pump having a brushless permanent magnet motor. The invention also relates to an electronic controller and a pump.

Pumps of pumping devices of dishwashing machines are usually implemented as shaded-pole motors or synchronous motors. Shaded-pole motors have the advantage of a high pumping rate and a defined running direction. This makes it possible to arrange the outlet tangentially on a pump housing. The problem with using shaded-pole motors is the fact that they are mostly "dry-running" devices, which means that costly sealing measures are needed. If the seal cannot be maintained, then the pump may fail.

Synchronous motors, on the other hand, are mostly "wet-running" devices, which allows a simpler mechanical design for a pump, because such costly sealing measures are not needed. Because of its operating principle, it is inherently impossible to define the running direction of an impeller of the pump. This has the advantage that if there is a blockage, e.g. when pumping out food residues, there is a chance that the blockage may be cleared by a change in the direction of rotation of the impeller. On the other hand, the randomly adopted running direction of the impeller means that the outlet must be arranged centrally on the pump housing. As a result of the adverse flow dynamics of this arrangement, synchronous motors can provide a low pumping rate compared with shaded-pole motors.

Also known from the prior art are brushless permanent magnet motors (brushless direct current motors, brushless alternating current motors, permanent magnet synchronous motors), which have been proposed for use in washing machines and dishwashing machines. The rotor of a brushless permanent magnet motor comprises one or more permanent magnets; the stator comprises a plurality of electromagnets. The electromagnets in the stator are commutated via an electronic controller e.g. using block commutation or sinusoidal commutation. Brushless permanent magnet motors therefore have the advantage that the direction of rotation of the stator, to which the impeller of the pump is fixed so as to rotate with it, can be set by the electronic controller. Furthermore, the pumping rate of a pump having a brushless permanent magnet motor can be controlled by adjusting the speed of the stator.

The principle of using brushless permanent magnet motors in domestic appliances is known from the prior art.

DE 195 33 076 A1 discloses a circuit for driving a brushless synchronous motor for a pump in a washing machine.

DE 198 46 831 A1 discloses a method for determining the rotor position of synchronous motors.

JP 2004278539A proposes the use of a pump having a brushless motor in a dishwashing machine. The dishwashing machine shown in this case makes use of a single pump for circulating the dishwashing solution in a closed water circuit and for pumping out the dishwashing solution from the dishwashing machine.

EP 1 502 535 A2 describes a circulating pump having a brushless motor, which can be used to control the fluid flow in a dishwashing machine. In particular, it is possible to deliver dishwashing solution optionally to the upper rack, the lower rack or both dishwasher ranks.

In addition, JP 2001276479 A discloses a pump having a brushless motor that has an axially arranged inlet and an outlet arranged tangentially on the pump housing.

BRIEF SUMMARY OF THE INVENTION

The object of the present invention is to define a dishwashing machine that has improved operating characteristics while being economic to manufacture.

In a dishwashing machine according to the invention having at least one pumping device for pumping dishwashing solution, with the pumping device having at least one pump having a brushless permanent magnet motor, the pumping device comprises a first pump and a second pump, each having a brushless permanent magnet motor, in particular a brushless direct current motor. In addition, a shared electronic controller is provided for the first pump and the second pump of the pumping device.

The use of pumps having a brushless permanent magnet motor, in particular a brushless direct current motor, allows substantial hydraulic improvements in a water circuit of the dishwashing machine. This is essentially achieved by an optimizable design of a pump housing of the pump. As a result of this, pumps having a brushless permanent magnet motor achieve a higher pumping rate, which can also be adjusted as required by means of the speed. Since pumps having a brushless permanent magnet motor are "wet-running" devices, costly sealing measures for the pump are not needed. Motors having brushless permanent magnet motors are normally assigned their own separate electronic controller. The method according to the invention of assigning a shared electronic controller to the first pump and the second pump enables the higher costs to be partially offset, however.

According to one embodiment, the electronic controller is designed to operate the first pump and the second pump of the pumping device in an alternating manner. Hence it suffices to provide only once the components needed for driving the brushless permanent magnet motor, e.g. a bridge circuit composed of MOSFET transistors, IGBTs (Insulated Gate Bipolar Transistors) or other switching elements, and to drive either the first pump or the second pump. It is not intended to operate the first pump and the second pump simultaneously.

The concept of operating the first pump and the second pump of the pumping device in an alternating manner shall be interpreted in the context of the present invention such that an arbitrarily long time period can exist between the operation of one pump and then the other, during which period neither of the two pumps is operated. This said, however, this interpretation shall also include the possibility that immediately after one pump stops operating, the other pump can be operated.

Whereas the first pump is a drain pump, which can be used to pump the dishwashing solution out of the dishwashing tub, the second pump is a circulating pump of the dishwashing machine, which can be used to pump the dishwashing solution in a closed water circuit of the dishwashing machine. The electronic controller comprises an electronic frequency converter for driving and supplying power to the pumping device.

According to another embodiment, the electronic controller is designed to detect the position of the rotor of the brushless permanent magnet motor, and to change the direction of rotation of the rotor on detecting an actual speed that differs from a target speed or from a target speed range. The position of the rotor of the brushless permanent magnet motor can here be detected without an additional sensor device because of the physical design of the motor. The position of the rotor can be measured, for example, via a reactive induction voltage or via the resultant current. The principle of determining the rotor position is known to the person skilled in the art, so a detailed description is not given here. From this information, the electronic controller is able to detect a difference between the speed and the target speed or the target speed range. If such a difference exists, this suggests a blockage, which e.g. in the drain pump may be caused by food residues or the like to be pumped out. It is possible to clear such a blockage of the pump by changing the direction of rotation, e.g. by changing the direction of rotation in an alternating manner, which can be controlled systematically by the electronic controller.

According to another embodiment, the electronic controller is designed to switch off the first pump and/or the second pump when a defined time has passed since the first pump and/or the second pump starts running. In other words, this means that the first pump and/or the second pump can be operated by a timing controller, which enables systematic switching on and off at defined times. In contrast, this is not possible in pumps having a synchronous motor, because with these pumps, owing to the random manner in which the rotor adopts a direction of rotation, an undefined time can pass before the pump starts running. As a result of this, dishwashing machines containing synchronous motors are operated for an extra time, e.g. 30 seconds, beyond the time period of the actual pump action. Power can be saved and noise reduced by the saving in this additional operating period of the pump.

In another embodiment, the electronic controller is designed to switch off the first pump and/or the second pump when a defined speed criterion is met. The speed criterion may be here a defined speed being exceeded. Alternatively, the speed criterion may be the detection of an increase in speed by a defined speed difference. This approach is based on the knowledge that the speed increases as soon as air is being pumped by the pump, i.e. the actual pumping operation of the dishwashing solution is finished.

According to another preferred embodiment, the first pump and/or the second pump have an inlet arranged centrally and axially to the shaft of an impeller, and an outlet arranged tangentially on a housing of the first pump and/or second pump. A substantial improvement in the hydraulic conditions is achieved in particular by the outlet arranged tangentially on the housing. This lets a pump having a brushless permanent magnet motor achieve a higher pumping rate than a conventional pump (whether it is a pump having a shaded-pole motor or having a synchronous motor).

The possibility of being able to operate at a defined speed a pump having a brushless permanent magnet motor means that there is also the possibility of being able to design the impeller, which is fixed to the rotor so as to rotate with it, to give better flow performance. This enables a further increase in the pumping rate.

These measures make it possible to generate a higher pressure at the outlet of the pump. This means that dishwashing solution pumped in the closed water circuit by the circulating pump can be sprayed at a higher pressure onto the items to be washed, thereby increasing the cleaning efficiency. It also means that a higher delivery height can be achieved with a correspondingly designed drain pump than with pumps having shaded-pole or synchronous motors. This means that the domestic connection can be placed higher than that of the prior art. Alternatively, however, the size of the pump can be adjusted to suit the delivery heights that currently need to be reached, thereby allowing a cut in the manufacturing costs of the dishwashing machine according to the invention.

The invention also relates to an electronic controller, which is designed for use in a dishwashing machine described above, and to a pump.

BRIEF DESCRIPTION OF THE DRAWINGS

The invention is described further below with reference to the figures, in which.

DETAILED DESCRIPTION OF EXEMPLARY EMBODIMENTS OF THE PRESENT INVENTION

Figure 1:
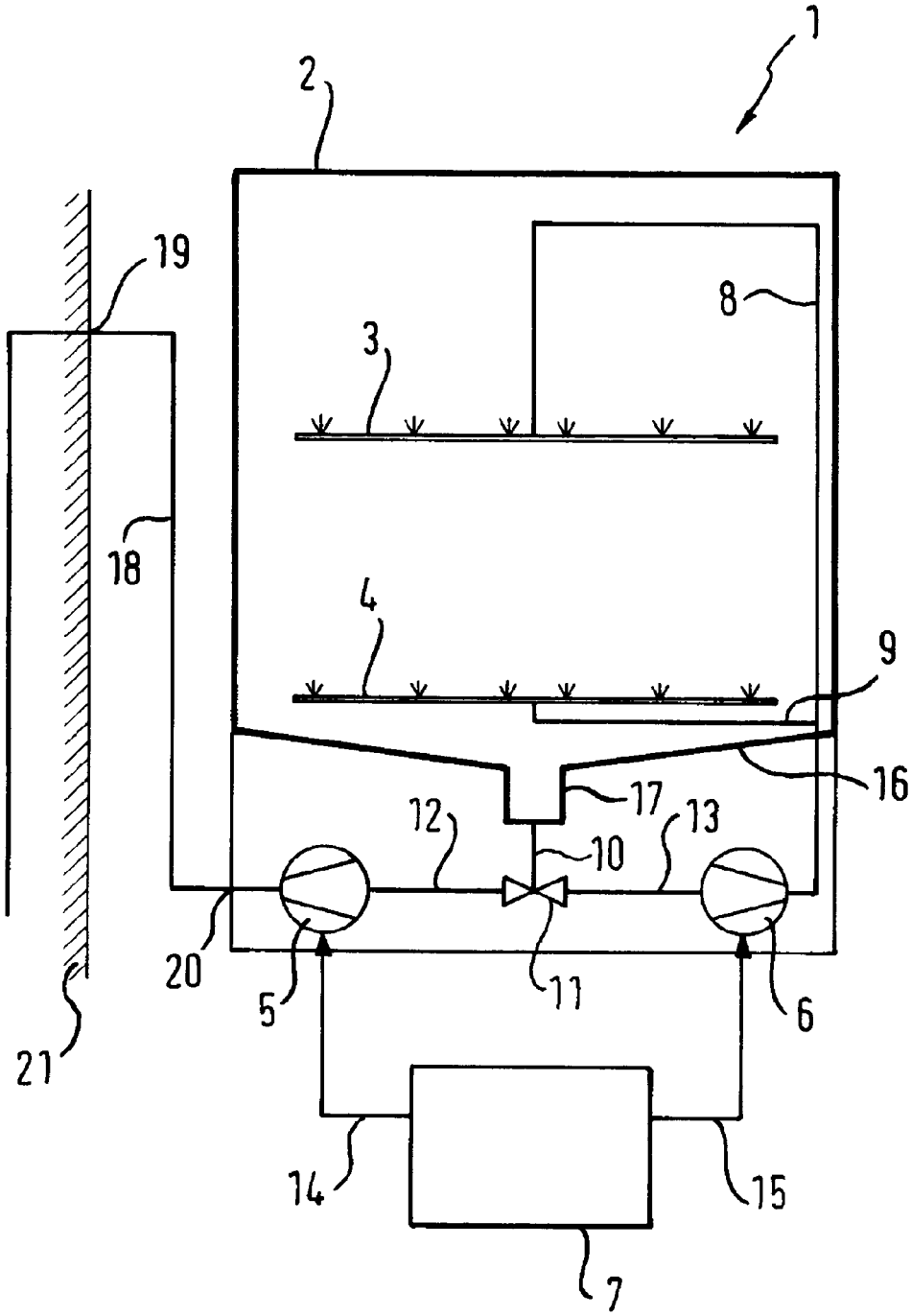
FIG. 1 shows a schematic diagram of a dishwashing machine according to the invention.

FIG. 1 shows schematically in a cross-sectional diagram a dishwashing machine 1 according to the invention. It comprises, in a known manner, a dishwashing tub 2. Two spray arms 3, 4 are arranged, likewise in a known manner, in the dishwashing tub 2, and are assigned to dishwashing racks (not shown) in a known manner. The dishwashing solution impinging on the items to be washed (also not shown) is fed into a pump well 17 by a dishwashing tray 16. The output of the pump well 17 is connected via a pipeline 12 or 13 to a drain pump 5 or to a circulating pump 6 respectively. The outlet of the circulating pump 6 is connected in a known manner via a pipeline 8 or 9 to the spray arm 3 or 4 respectively. An outlet of the drain pump 5 is connected to an outlet 20 of the dishwashing machine so that the dirty dishwashing fluid pumped by the drain pump 5 can be pumped via a pipeline 18 to a domestic connection 19 placed in a wall 21, where a defined height difference between outlet 20 and domestic connection 19 must be overcome.

The drain pump 5 and the circulating pump 6 are operated and driven under the control of a shared electronic controller 7. This is connected to the drain pump 5 via a control line 14, and to the circulating pump 6 via a control line 15. The electronic controller includes an electronic frequency converter, e.g. a bridge circuit, for driving and supplying power to the drain pump 5 or to the circulating pump 6. Here, the electronic frequency converter is provided only once in the electronic controller 7. This is sufficient because the drain pump 5 or the circulating pump 6 are never operated simultaneously, but in an alternating manner under the control of the programmable controller.

Figure 2:
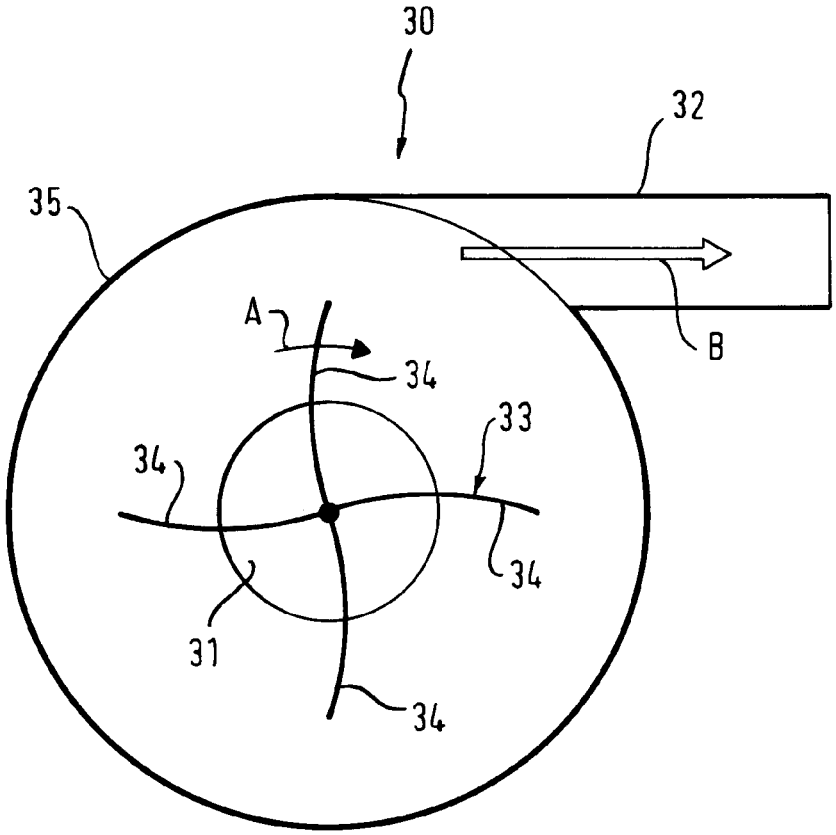
FIG. 2 shows a schematic diagram of a pump in cross-section, which can be used in the dishwashing machine according to the invention and has a brushless permanent magnet motor.

FIG. 2 shows a schematic diagram of an exemplary design of a pump 30 having a brushless permanent magnet motor (not shown). The pump 30 can here represent the drain pump 5 and/or the circulating pump 6. In theory, all known types, such as e.g. brushless direct current motors (BLDC), brushless alternating current motors (BLAC) or permanent magnet synchronous motors (PMSM), are eligible as permanent magnet motors. Brushless direct current motors are preferably used. A pump housing 35 is provided with an inlet 31 arranged axially to a shaft of an impeller 33 and with a tangentially arranged outlet 32. A indicates the direction of rotation of the impeller 33. B indicates the flow direction achieved with pump 30 operating in direction of rotation A. Not only is it inherently possible, because of the operating principle, to adjust the speed of the impeller 33 as required by the electronic controller, but also such an arrangement at the outlet has only low hydraulic resistances to overcome, so that the pump 30 has a higher pumping rate than conventional pumps. This can be further improved by the shape of the, for example, four vanes 34 of the impeller 33. The optimum number and design of the vanes 34 can be determined by known means by simulations.

Hence the use of a circulating pump having a brushless permanent magnet motor enables a higher maximum pressure to be achieved at the jets of the spray arm, whereby the cleaning efficiency is improved compared with conventional dishwashing machines. If too high a pressure is undesirable, e.g. for sensitive dishes, then it can be reduced by simple speed regulation (reducing the pump speed).

The use of a drain pump having a brushless permanent magnet motor means that, because of the higher pumping rate compared with conventional pumps, a greater height difference between the outlet 20 of the dishwashing machine and the domestic connection 19 in the wall 21 can be overcome, whereby the domestic connection 19 in the wall 21 could be placed in another position. Conversely, if the height difference between the outlet 20 of the dishwashing machine and the domestic connection 19 remains at the level designed for conventional dishwashing machines according to the prior art, the size of the drain pump 5 can be adjusted to suit this height difference. This results in a physically smaller drain pump. In addition to reduced manufacturing costs, extra space is thereby available for other components in the dishwashing machine.

If physical circumstances do not allow an outlet arranged tangentially on the pump housing to be provided, then it is also possible to provide the outlet in another position, e.g. arranged centrally.

Thus the present invention provides a dishwashing machine that not only has improved operating properties but is also more economic to manufacture.

LIST OF REFERENCES

1 dishwashing machine
2 dishwashing tub
3 spray arm
4 spray arm
5 pump
6 pump
7 electronic controller
8 pipeline
9 pipeline
12 pipeline
13 pipeline
14 control line
15 control line
16 dishwashing tray
17 pump well
18 pipeline
19 domestic connection
20 outlet
21 wall
30 pump
31 pump inlet
32 pump outlet
33 impeller
34 vane
35 pump housing

The invention claimed is:

1. A dishwashing machine, comprising:

a pumping device to pump a dishwashing solution, the pumping device having a first pump and a second pump, each of the first pump and the second pump having a brushless permanent magnet motor; and a shared electronic controller shared by the first pump and the second pump, wherein the brushless permanent magnet motor has a rotor, and the shared electronic controller is configured to detect a position of the rotor and to change the direction of rotation of the rotor on detecting an actual speed that differs from one of a target speed and a target speed range.

2. The dishwashing machine of claim 1, wherein the shared electronic controller is configured to operate the first pump and the second pump of the pumping device in an alternating manner.

3. The dishwashing machine of claim 1, further comprising a dishwashing tub, wherein the first pump is a drain pump to pump the dishwashing solution out of the dishwashing tub.

4. The dishwashing machine of claim 1, wherein the second pump is a circulating pump to pump the dishwashing solution in a closed water circuit of the dishwashing machine.

5. The dishwashing machine of claim 1, wherein the shared electronic controller comprises an electronic frequency converter to drive and supply power to the pumping device.

6. The dishwashing machine of claim 1, wherein the shared electronic controller is configured to switch off at least one of the first pump and the second pump after passage of a predetermined time following a start of the at least one of the first pump and the second pump.

7. The dishwashing machine of claim 1, wherein the shared electronic controller is structured to switch off at least one of the first pump and the second pump when a predetermined speed criterion is met.

8. The dishwashing machine of claim 7, wherein the predetermined speed criterion is defined by exceeding a predetermined speed.

9. The dishwashing machine of claim 7, wherein the speed criterion is defined by detecting a speed increase by a predetermined speed difference.

10. The dishwashing machine of claim 1, further comprising:

an impeller having a shaft; and a respective housing for each of the first pump and the second pump; wherein at least one of the first pump and the second pump has an inlet that is arranged centrally and axially in relation to the shaft of the impeller; and wherein the at least one of the first pump and the second pump has an outlet that is arranged tangentially at the respective housing.

11. The dishwashing machine of claim 1, wherein the brushless permanent magnet motor is a brushless direct current motor.

12. A dishwasher comprising at least one conveying device for conveying wash liquor, the conveying device having a first pump and a second pump each with a brushless permanent magnet motor that is a brushless direct current motor (Brushless DC, BLDC), and common control electronics provided for the first and the second pump of the conveying device, the common control electronics switching off the first and/or the second pump when a predefined time has elapsed since the first and/or the second pump was started.

* * * * *

UNITED STATES PATENT AND TRADEMARK OFFICE

CERTIFICATE OF CORRECTION

PATENT NO. : 8,603,261 B2
APPLICATION NO. : 12/664898
DATED : December 10, 2013
INVENTOR(S) : Rosenbauer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 969 days.

Signed and Sealed this
Twenty-second Day of September, 2015

Michelle K. Lee

Michelle K. Lee
*Director of the United States Patent and Trademark Office*